US008742878B2

(12) United States Patent
Park et al.

(10) Patent No.: US 8,742,878 B2
(45) Date of Patent: Jun. 3, 2014

(54) TRANSFORMER AND FLAT PANEL DISPLAY DEVICE INCLUDING THE SAME

(75) Inventors: Geun Young Park, Gyunggi-do (KR); Myeong Sik Cheon, Gyunggi-do (KR); Choong Sik Yoo, Gyunggi-do (KR); Jae Hyun Lee, Gyunggi-do (KR); Young Min Lee, Gyunggi-do (KR); Hwi Beom Shin, Gyeongsangnam-do (KR); Sang Joon Seo, Gyunggi-do (KR); Jong Hae Kim, Gyunggi-do (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 0 days.

(21) Appl. No.: 13/175,678

(22) Filed: Jul. 1, 2011

(65) Prior Publication Data

US 2012/0001887 A1 Jan. 5, 2012

(30) Foreign Application Priority Data

Jul. 2, 2010 (KR) ..... 10-2010-0063720
Sep. 20, 2010 (KR) ..... 10-2010-0092700
Jun. 14, 2011 (KR) ..... 10-2011-0057272

(51) Int. Cl.
*H01F 27/30* (2006.01)

(52) U.S. Cl.
USPC ..... 336/198

(58) Field of Classification Search
USPC ..... 336/192, 198, 196, 200, 232
See application file for complete search history.

(56) References Cited

U.S. PATENT DOCUMENTS 3,652,968 A 3/1972 Johnston et al.
3,958,328 A 5/1976 Lee
4,250,479 A 2/1981 Bausch et al.
4,596,974 A 6/1986 Tobben et al.
4,857,878 A 8/1989 Eng, Jr. et al.
4,967,121 A 10/1990 Nero (Continued)

FOREIGN PATENT DOCUMENTS

CN 1497296 A 5/2004
CN 1514424 A 7/2004

(Continued)

OTHER PUBLICATIONS

United States Office Action issued in U.S. Appl. No. 13/175,438 dated Aug. 16, 2012.

(Continued)

*Primary Examiner* — Tuyen Nguyen
(74) *Attorney, Agent, or Firm* — McDermott Will & Emery LLP

(57) ABSTRACT

There are provided a thin transformer capable of being used in a thin display device such as a liquid crystal display (LCD) device, a light emitting diode (LED) display device, and a flat panel display device including the same. The transformer includes: a bobbin part including inner and outer bobbins each including a pipe shaped body part having a though-hole formed in an inner portion thereof and a flange part protruding outwardly from both ends of the body part; coils respectively wound around the inner and outer bobbins; and a core electromagnetically coupled to the coils to thereby form a magnetic path, wherein the inner bobbin is inserted into the through-hole of the outer bobbin to thereby be coupled to the outer bobbin and at least one of the inner and outer bobbins includes the flange part having a width larger than a thickness of the body part.

13 Claims, 11 Drawing Sheets

(56) References Cited

U.S. PATENT DOCUMENTS

| | | | | |
|---|---|---|---|---|
| 5,673,013 | A | 9/1997 | Moody et al. | |
| 6,046,663 | A * | 4/2000 | Kubomura et al. | 336/198 |
| 6,127,912 | A | 10/2000 | Dust et al. | |
| 6,344,786 | B1 | 2/2002 | Chin | |
| 6,611,189 | B2 | 8/2003 | Sigl | |
| 6,900,717 | B2 | 5/2005 | Timashov et al. | |
| 2003/0030531 | A1 | 2/2003 | Okano et al. | |
| 2004/0125065 | A1 | 7/2004 | Park et al. | |
| 2004/0224598 | A1 | 11/2004 | Tanaka | |
| 2005/0275498 | A1 | 12/2005 | Haga | |
| 2006/0255898 | A1 | 11/2006 | Sawazaki et al. | |
| 2007/0165151 | A1 | 7/2007 | Lee et al. | |
| 2007/0273466 | A1 | 11/2007 | Yang et al. | |
| 2008/0180205 | A1 | 7/2008 | Tsai et al. | |
| 2009/0237195 | A1 | 9/2009 | Zeng et al. | |

FOREIGN PATENT DOCUMENTS

| | | | |
|---|---|---|---|
| CN | 1991453 | A | 7/2007 |
| CN | 101241798 | A | 8/2008 |
| CN | 201142269 | Y | 10/2008 |
| CN | 101521095 | A | 9/2009 |
| CN | 101673611 | A | 3/2010 |
| GB | 2112746 | A | 7/1983 |
| JP | 61-133614 | A | 6/1986 |
| JP | 61-140515 | | 8/1986 |
| JP | 62005622 | A | 1/1987 |
| JP | 63-170915 | | 11/1988 |
| JP | 1156523 | U | 10/1989 |
| JP | 03-279167 | A | 12/1991 |
| JP | 03284807 | A | 12/1991 |
| JP | 05-038845 | | 2/1993 |
| JP | 5-66935 | U | 9/1993 |
| JP | 05-283248 | A | 10/1993 |
| JP | 05-304033 | A | 11/1993 |
| JP | 5-90928 | U | 12/1993 |
| JP | 06-013124 | | 1/1994 |
| JP | 6-112058 | A | 4/1994 |
| JP | 06-295828 | | 10/1994 |
| JP | 7-022526 | U | 4/1995 |
| JP | 07-022526 | U | 4/1995 |
| JP | 07-326524 | A | 12/1995 |
| JP | 08-069928 | A | 3/1996 |
| JP | 08-153630 | | 6/1996 |
| JP | 09-129457 | | 5/1997 |
| JP | 2569842 | Y2 | 2/1998 |
| JP | 2001-250728 | | 9/2001 |
| JP | 2001-305972 | A | 11/2001 |
| JP | 2001-350133 | A | 12/2001 |
| JP | 2002-313641 | A | 10/2002 |
| JP | 3454801 | | 7/2003 |
| JP | 2005-158927 | | 6/2005 |
| JP | 2009-117660 | | 5/2009 |
| KR | 2004-0101697 | A | 12/2004 |
| KR | 10-2006-0035561 | A | 4/2006 |

OTHER PUBLICATIONS

Japanese Office Action issued in Japanese Patent Application No. 2011-147586 dated Jun. 5, 2012.

US Office Action issued in U.S. Appl. No. 13/175,471 dated Oct. 9, 2012.

Korean Office Action, with English translation, issued in Korean Patent Application No. 10-2011-0057272, dated Sep. 19, 2011.

Japanese Office Action for Patent Application No. 2011-147692 and English abstract dated Mar. 5, 2013.

Japanese Office Action for Patent Application No. 2011-147586 and English abstract dated Mar. 5, 2013.

United States Office Action issued in U.S. Appl. No. 13/175,290 mailed on Feb. 14, 2013.

United States Office Action issued in U.S. Appl. No. 13/175,438 mailed on Feb. 19, 2013.

United States Office Action issued in U.S. Appl. No. 13/175,640 mailed on Jan. 30, 2013.

Office Action issued in U.S. Appl. No. 13/175,438 dated Jun. 6, 2013.

Office Action issued in Japanese Patent Application No. 2011-147753 dated May 7, 2013.

United States Office Action issued in U.S. Appl. No. 13/175,632 dated Aug. 9, 2013.

Chinese Office Action, w/English translation thereof, issued in Chinese Patent Application No. CN 201110191334.8 dated Oct. 12, 2013.

Chinese Office Action issued in Chinese Patent Application No. CN 201110191489.1 dated Sep. 27, 2013.

Chinese Office Action with Full English Translation issued in Chinese Application No. 201110191452.9 mailed Oct. 8, 2013.

Chinese Office Action, w/English translation thereof, issued in Chinese Patent Application No. CN 201110191128.7 dated Oct. 22, 2013.

* cited by examiner

TRANSFORMER AND FLAT PANEL DISPLAY DEVICE INCLUDING THE SAME

CROSS-REFERENCE TO RELATED APPLICATIONS

This application claims the priority of Korean Patent Application Nos. 10-2010-0063720 filed on Jul. 2, 2010, 10-2010-0092700 filed on Sep. 20, 2010, and 10-2011-0057272 filed on Jun. 14, 2011, in the Korean Intellectual Property Office, the disclosures of which are incorporated herein by references.

BACKGROUND OF THE INVENTION

1. Field of the Invention

The present invention relates to a thin transformer capable of being used in a thin display device such as a liquid crystal display (LCD) device, a light emitting diode (LED) display device, and a flat panel display device including the same.

2. Description of the Related Art

Recently, a flat panel display (FPD) which is a new technology appropriate for a multi-media system having a high resolution and a large-sized screen, or the like, has been prominent in the field of displays, instead of a cathode ray tube (CRT).

Particularly, a thin display such as a liquid crystal display (LCD) television (TV) or a plasma display panel (PDP) TV has been spotlighted in a large-sized display. In the future, it is expected that the thin display will be popular in view of cost and marketability.

A cold cathode fluorescent lamp (CCFL) has been used as a backlight light source in LCD TVs. However, the use of a light emitting diode (LED) has recently been increased due to relatively reduced power consumption, prolonged lifespan, environmental friendliness, and the like.

In accordance with the use of the LED, a backlight unit has been miniaturized. As a result, a thickness of a flatscreen TV has gradually been reduced. In addition, the demand for the slimness of a power supply module within the flatscreen TV has been increased.

In the case of the transformer according to the related art, coils are generally wound perpendicularly to a printed circuit board. In addition, a core is provided in a form in which it forms a magnetic path in parallel with the printed circuit board. Therefore, a magnetic path of a majority of the leakage magnetic flux of the transformer is formed through a space between a back cover and the transformer (or a space between the printed circuit board and the transformer).

Accordingly, in the case of the transformer according to the related art, since the leakage magnetic flux is distributed over the space between the back cover and the transformer, when the back cover and the transformer have a narrow interval therebetween in order to obtain a display device slim, interference is generated between the back cover formed of a metallic material and the leakage magnetic flux, such that noise is generated while the back cover is vibrated.

In addition, it requires significant manpower to produce a transformer according to the related art. That is, since most of a production process is manually performed, there is a limitation in increasing productivity or securing reliability.

SUMMARY OF THE INVENTION

An aspect of the present invention provides a thin transformer capable of being easily used in a thin display device, or the like, and a flat panel display device including the same.

Another aspect of the present invention provides a transformer capable of being automatically produced, and a flat panel display device including the same.

Another aspect of the present invention provides a transformer having a structure in which individual bobbins may be easily coupled to each other so that automatic production is easily performed, and a flat panel display device including the same.

According to an aspect of the present invention, there is provided a transformer including: a bobbin part including inner and outer bobbins each including a pipe shaped body part having a though-hole formed in an inner portion thereof and a flange part protruding outwardly from both ends of the body part; coils respectively wound around the inner and outer bobbins; and a core electromagnetically coupled to the coils to thereby form a magnetic path, wherein the inner bobbin is inserted into the through-hole of the outer bobbin to thereby be coupled to the outer bobbin and at least one of the inner and outer bobbins includes the flange part having a width larger than a thickness of the body part.

The inner bobbin may be inserted into the through-hole of the outer bobbin so that the flange part of the inner bobbin and the flange part of the outer bobbin are disposed on the same plane.

Each of the inner and outer bobbins may include a terminal connection part protruding outwardly from one side of a lower flange part formed at a lower end of the body part and having a plurality of external connection terminals connected thereto.

The terminal connection part respectively included in the inner and outer bobbins may include lead grooves formed in spaces between the external connection terminals, and the coil may lead to the outside of the bobbin part via the lead groove.

The inner bobbin may include at least one fitting protrusion protruding from an outer peripheral edge of an upper flange part formed at an upper end of the body part in an outer diameter direction thereof.

In the case of the fitting protrusion, a pair of fitting protrusions may protrude from the outer peripheral edge of the upper flange part of the inner bobbin in opposing directions.

The inner bobbin may include a support jaw protruding from a position corresponding to the fitting protrusion in an outer peripheral edge of the lower flange part formed at the lower end of the body part in the outer diameter direction.

The outer bobbin may include a pair of coupling grooves formed at positions at which they face a pair of fitting protrusions and having the fitting protrusions coupled thereto while being inserted thereinto.

The coupling grooves may be formed in a groove shape in an upper end of an inner peripheral surface of the body part of the outer bobbin and include fitting grooves having the fitting protrusions inserted thereinto.

At least one of the pair of coupling grooves may include a guide groove formed in a groove shape traversing the inner peripheral surface of the body part of the outer bobbin from the fitting groove toward the lower end of the body part of the outer bobbin to thereby guide the fitting protrusion to the fitting groove.

The guide groove may have an inclined bottom surface, and the bottom surface may have a depth that becomes shallower toward the fitting groove.

The inner and outer bobbins may be fixedly coupled to each other by fitting the fitting protrusion into the fitting groove and supporting a lower surface of the lower flange part of the outer bobbin by the terminal connection part and the support jaw of the inner bobbin.

At least one of an outer peripheral edge of the flange part of the inner bobbin and an inner peripheral surface of the through-hole of the outer bobbin may include at least one fitting protrusion protruding therefrom, and the other thereof may include a coupling groove formed to correspond to the fitting protrusion and having the fitting protrusion coupled thereto.

The coil may include a primary coil wound around the inner bobbin and a secondary coil wound around the outer bobbin, and at least one of the primary and secondary coil may include a plurality of coils electrically insulated from each other.

The bobbin part may further include at least one intermediate bobbin interposed between the outer bobbin and the inner bobbin.

The terminal connection part of the inner bobbin and the terminal connection part of the outer bobbin may be disposed in opposing directions.

An outer peripheral edge disposed on an upper part of the terminal connection part of the inner bobbin in an outer peripheral edge of the flange part formed at the upper end of the body part of the inner bobbin may be bent corresponding to connection positions of the external connection terminals of the inner bobbin.

According to another embodiment of the present invention, there is provided a flat panel display device including: a switching mode power supply including at least one transformer as described above mounted on a substrate thereof; a display panel receiving power from the switching mode power supply; and covers protecting the display panel and the switching mode power supply.

Coils of the transformer may be wound around the inner and outer bobbins, respectively, so as to be in parallel with the substrate of the switching mode power supply.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE INVENTION

Figure 1A:
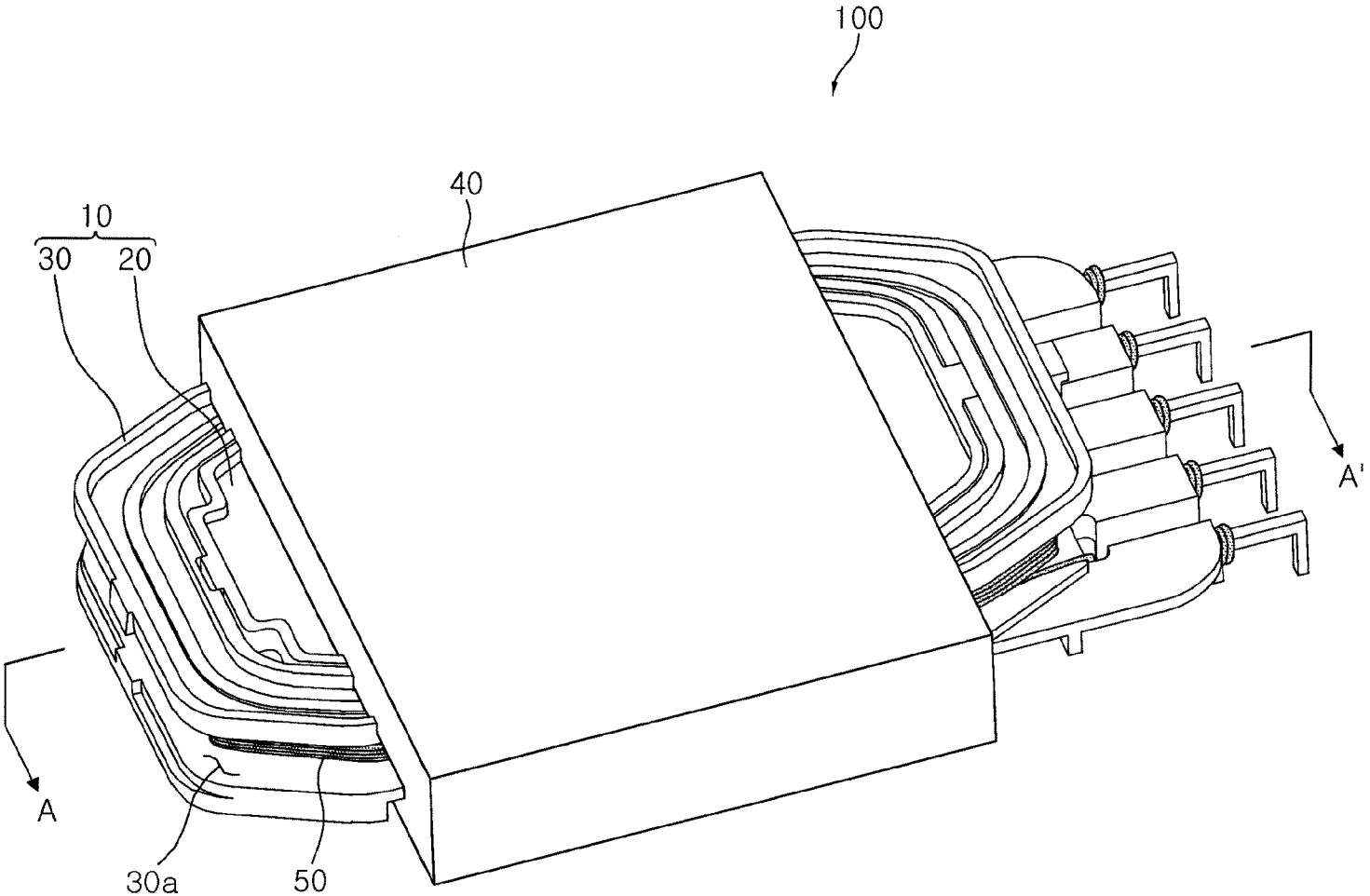
FIGS. 1A and 1B are perspective views schematically showing a transformer according to an embodiment of the present invention.

The terms and words used in the present specification and claims should not be interpreted as being limited to typical meanings or dictionary definitions, but should be interpreted as having meanings and concepts relevant to the technical scope of the present invention based on the rule according to which an inventor can appropriately define the concept of the term to most appropriately describe the best method he or she knows for carrying out the invention. Therefore, the configurations described in the embodiments and drawings of the present invention are merely the most preferable embodiments but do not represent all of the technical spirit of the present invention. Thus, the present invention should be construed as including all the changes, equivalents, and substitutions included in the spirit and scope of the present invention at the time of filing this application.

In addition, it needs to be noted that like reference numerals denote like elements in the accompanying drawings. Moreover, a detailed description of well-known functions or configurations will be omitted in order not to unnecessarily obscure the subject matter of the present invention.

For the same reason, it is to be noted that some components shown in the accompanying drawings are exaggerated, omitted or schematically illustrated, and the size of each component does not exactly reflect its real size.

Hereinafter, embodiments of the present invention will be described in detail with reference to the accompanying drawings.

Figure 1B:
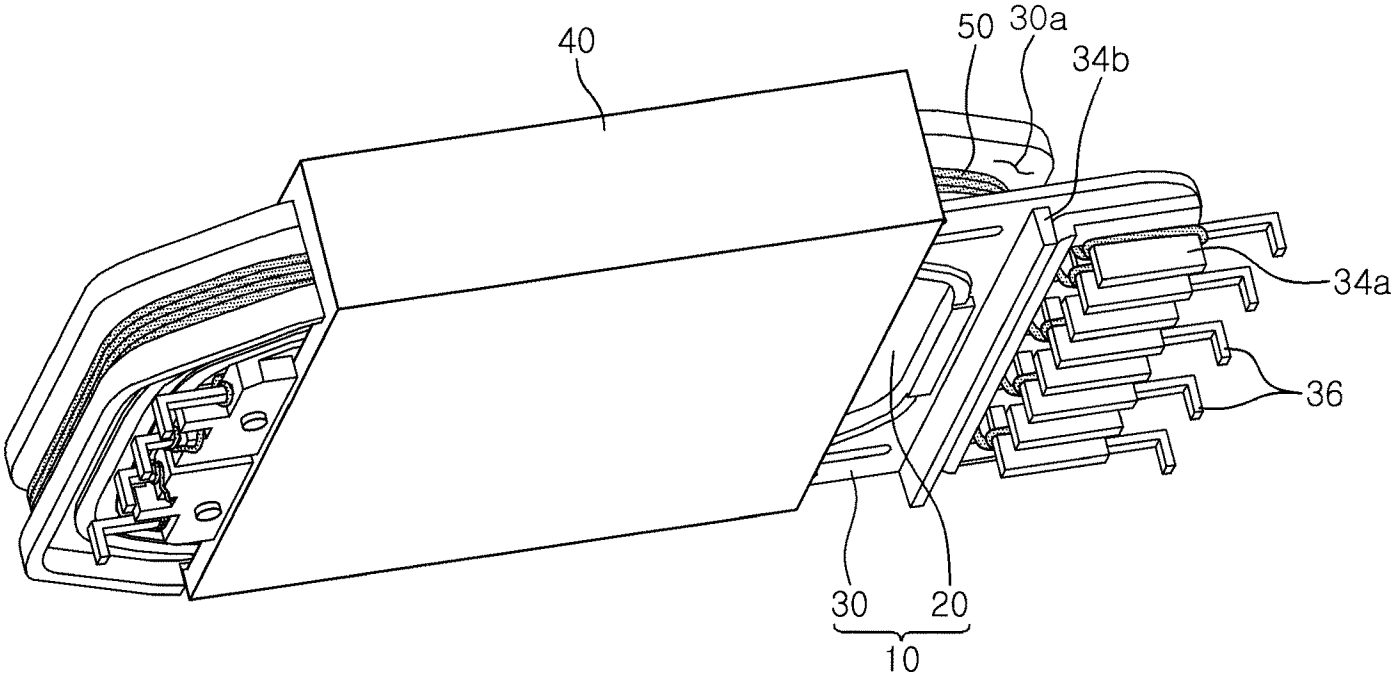
Figure 2:
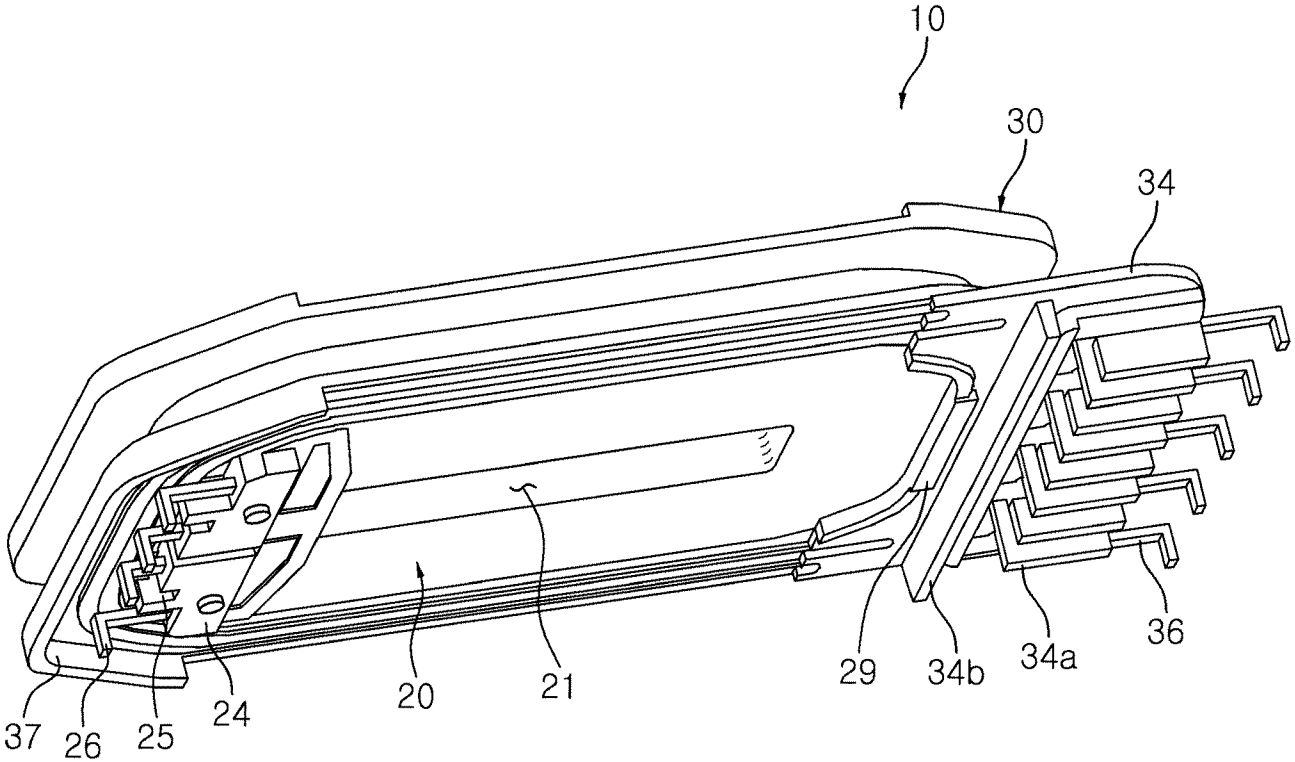
FIG. 2 is a perspective view schematically showing a bobbin part of the transformer shown in FIG. 1B.
Figure 3:
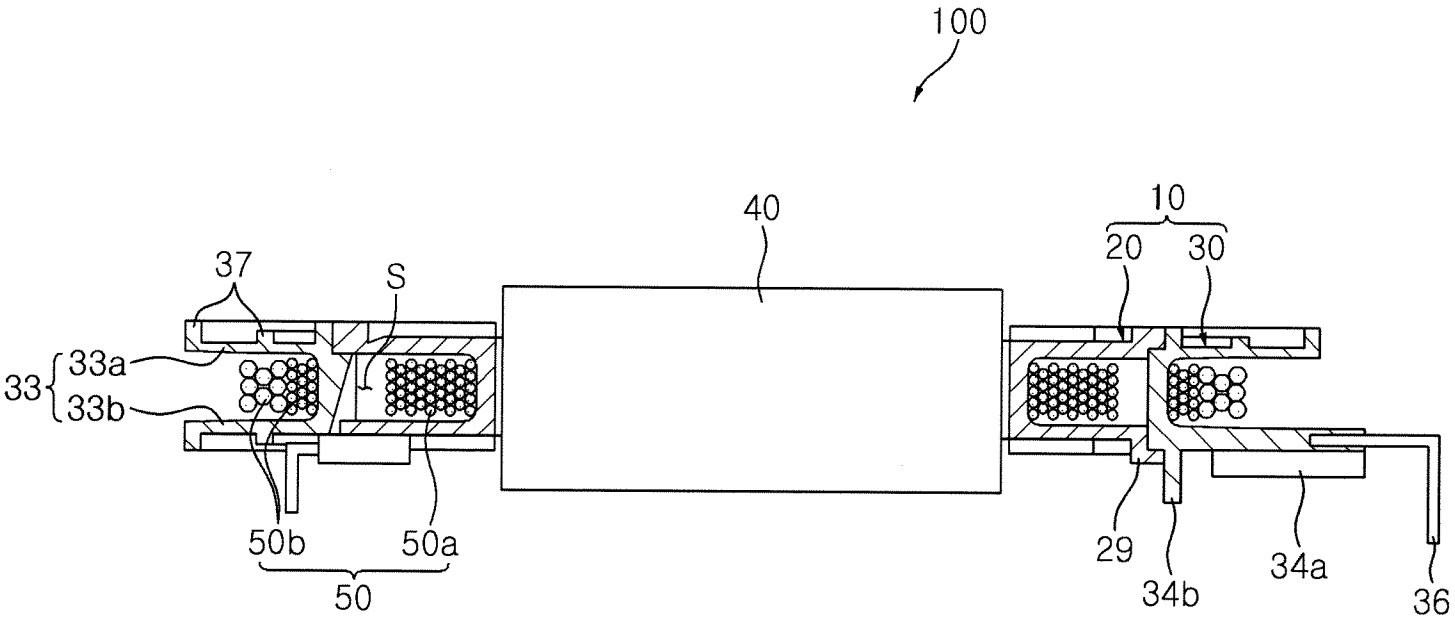
FIG. 3 is a cross-sectional view taken along line A-A' of the transformer shown in FIG. 1A.

FIGS. 1A and 1B are perspective views schematically showing a transformer according to an embodiment of the present invention; FIG. 2 is a perspective view schematically showing a bobbin part of the transformer shown in FIG. 1B; and FIG. 3 is a cross-sectional view taken along line A-A' of the transformer shown in FIG. 1A.

Figure 4:
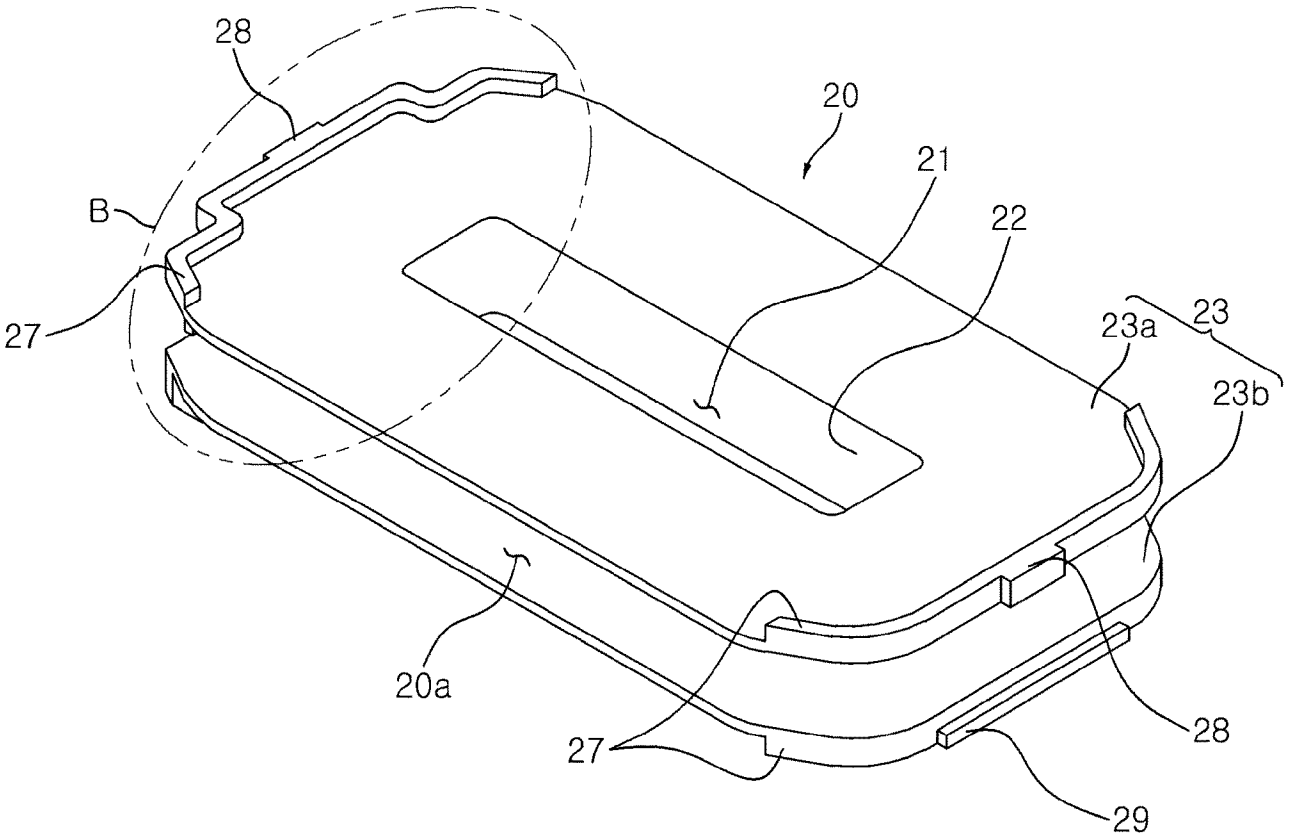
FIG. 4 is a perspective view schematically showing an inner bobbin of the transformer shown in FIG. 1A.
Figure 5:
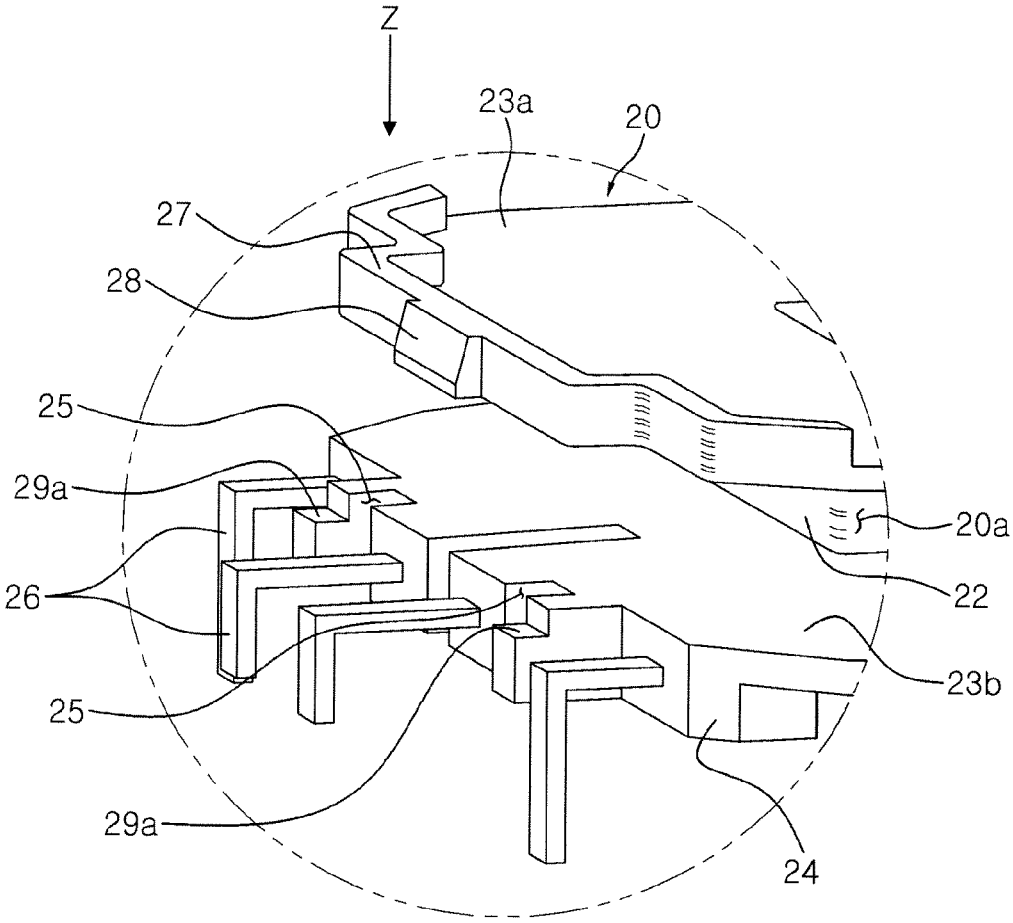
FIG. 5 is a partially enlarged perspective view showing part B of FIG. 4 at another angle.
Figure 6:
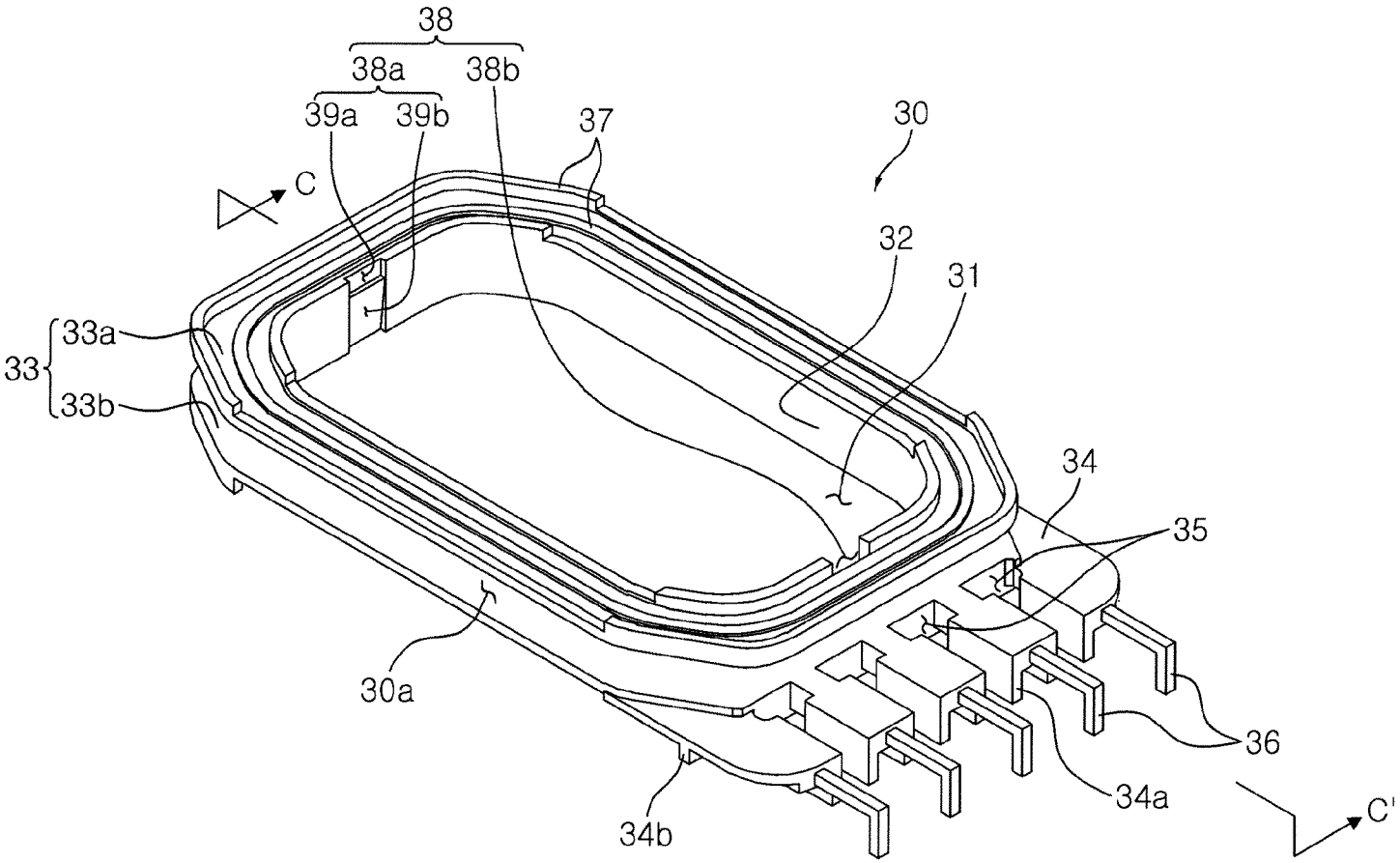
FIG. 6 is a perspective view schematically showing an outer bobbin of the transformer shown in FIG. 1A.
Figure 7A:
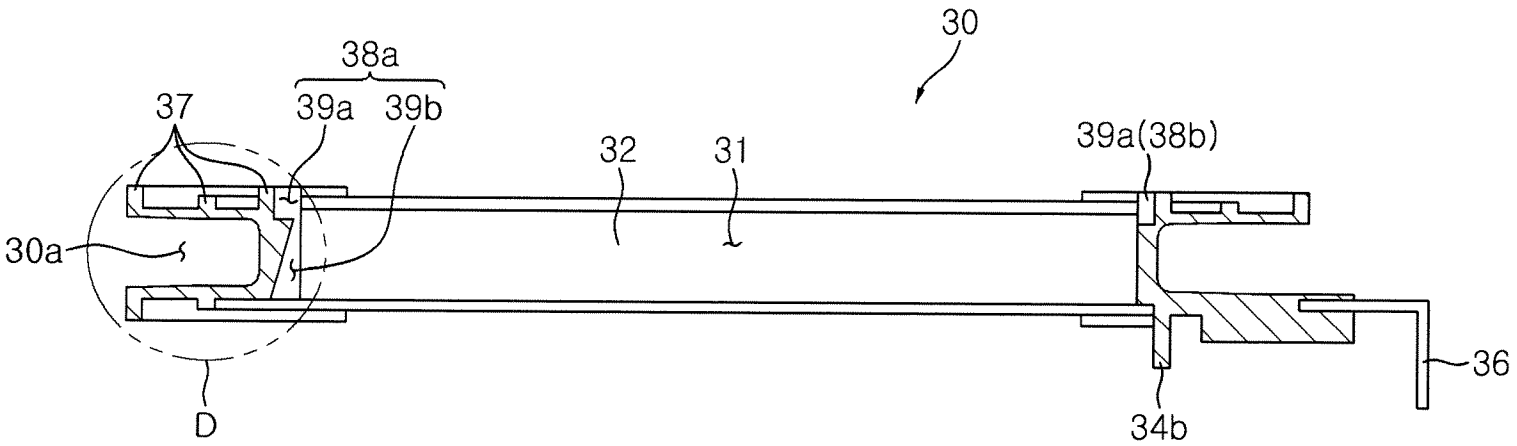
FIG. 7A is a cross-sectional view taken along line C-C' of the outer bobbin shown in FIG. 6.
Figure 7B:
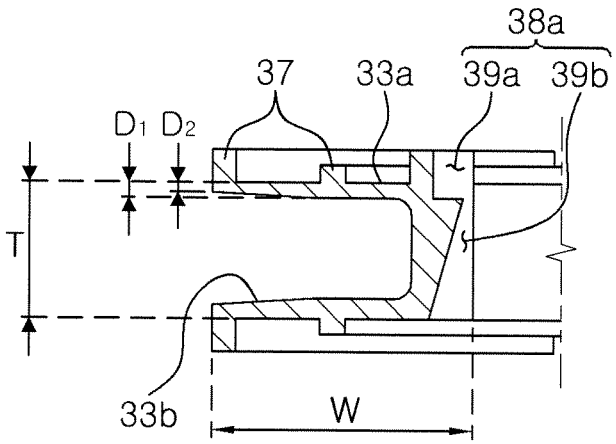
FIG. 7B is a partially enlarged cross-sectional view of part D of FIG. 7A.

FIG. 4 is a perspective view schematically showing an inner bobbin of the transformer shown in FIG. 1A; and FIG. 5 is a partially enlarged perspective view showing part B of FIG. 4 at another angle. FIG. 6 is a perspective view schematically showing an outer bobbin of the transformer shown in FIG. 1A; FIG. 7A is a cross-sectional view taken along line C-C' of the outer bobbin shown in FIG. 6; and FIG. 7B is a partially enlarged cross-sectional view of part D of FIG. 7A.

Referring to FIGS. 1A through 7B, a transformer 100 according to an embodiment of the present invention may include a bobbin part 10, a coil 50, and a core 40.

The bobbin part 10 may include an outer bobbin 30 and at least one inner bobbin 20.

The inner bobbin 20 may include a pipe shaped body part 22 having a through-hole 21 formed at the center of an inner portion thereof, a flange part 23 extended from both ends of the body part 22 in an outer diameter direction thereof, external connection terminals 26 for electrical and physical connection to the outside, and a terminal connection part 24 having the external connection terminals 26 connected thereto, as shown in FIGS. 4 and 5.

The through-hole 21 formed in the inner portion of the body part 22 may be used as a path into which a portion of the core 40 to be described below is inserted. The present embodiment describes a case in which the through-hole 21 has a rectangular cross section by way of example. The cross sectional shape corresponds to a shape of the core 40 inserted into the through-hole 21. In the inner bobbin 20 according to an embodiment of the present embodiment, the through-hole 21 is not limited to having the above-mentioned shape but may have various shapes corresponding to shapes of the core 40 inserted thereinto.

The flange part 23 may be divided into an upper flange part 23*a* and a lower flange part 23*b* according to a formation position thereof. In addition, a space between an outer peripheral surface of the body part 22 and the upper and lower flange parts 23*a* and 23*b* may be used as an inner winding part 20*a* around which a coil 50 to be described below is wound. Therefore, the flange part 23 may serve to protect the coil 50 from the outside and secure an insulation property therebetween, simultaneously with supporting the coil 50 wound around the inner winding part 20*a* at both sides thereof.

The lower flange part 23*b* of the inner bobbin 20 may include the terminal connection part 24 formed on one side thereof, wherein the terminal connection part 24 includes the external connection terminals 26 connected thereto. The terminal connection part 24 may protrude outwardly (that is, downwardly) from one side of the lower flange part 23*b*, and may include at least one lead groove 25 into which a lead wire of the coil 50 wound around the inner winding part 20*a* is inserted. The lead wire of the coil 50 may lead to the outside of the inner bobbin 20 by the lead groove 25.

The external connection terminals 26 may be provided to protrude from the terminal connection part 24 in a downward direction or an outer diameter direction of the body part 22 while being connected to the terminal connection part 24. Particularly, the external connection terminals 26 according to the present embodiment may be disposed along an outer peripheral edge of the lower flange part 23*b* and may be connected to the terminal connection part 24.

In addition, the terminal connection part 24 of the inner bobbin 20 may include support parts 29*a* protruding along the outer diameter direction of the body part 22. The support parts 29*a* may be formed in spaces between the external connection terminals 26 disposed to be spaced apart from each other by predetermined intervals, and support the outer bobbin 30 while contacting a lower surface of the outer bobbin 30, similar to a support jaw 29 to be described below.

Meanwhile, the present embodiment describes a case in which the support parts 29*a* protrude in a direction parallel with a direction in which the external connection terminals 26 protrude by way of example. However, the support parts 29*a* according to the present embodiment are not limited thereto but may be formed in various forms. For example, the support parts 29*a* may protrude from a side of the terminal connection part 24 in a direction perpendicular to a direction in which the external connection terminals 26 protrude.

In addition, the upper flange part 23*a* of the inner bobbin 20 according to the present embodiment may have an outer peripheral edge of one side thereof different from that of the other side thereof. That is, the upper flange part 23*a* may be formed so that the outer peripheral surface disposed at one side thereof, which is an upper portion of the terminal connection part 24, is not formed in an arc shape or a straight line shape but is bent.

Here, the bending may be formed to correspond to positions of the outer connection terminals 26 connected to the terminal connection part 24. That is, when viewed in a Z direction of FIG. 5, the bending may be formed so that the external connection terminals 26 fastened to the terminal fastening part 24 may be maximally exposed.

The bending of the upper flange part 23*a* may be provided to automatically wind the coil 50 around the inner bobbin 20. More specifically, the bending may be formed in order to prevent the coil 50 or an automatic winding device (now shown) from contacting the upper flange part 23*a* during a process in which the automatic winding device winds the coil 50 while rotating the coil 50 around a circumference of the external connection terminal 26 in order to wind the coil 50 around the external connection terminal 26.

Therefore, when the coil 50 or the automatic winding device does not contact the upper flange part 23*a* during an automatic winding process, the bending formed in the upper flange part 23*a* may be omitted.

Meanwhile, in order to form a thin transformer 100, the flange part 23 included in the inner bobbin 20 may have a maximally reduced thickness. However, the inner bobbin 20 according to the present embodiment may be formed of a resin material, which is an insulating material. Therefore, when the flange part 23 has an excessively reduced thickness, it does not maintain its shape, such that it may be bent.

Therefore, the transformer 100 according to the present embodiment may include an insulating rib 27 formed on an outer surface of the flange part 23 in order to prevent the flange part 23 from being bent and reinforce strength of the flange part 23. The insulating rib 27 may be formed on both of outer surfaces of the two flange parts 23*a* and 23*b* included in the inner bobbin 20 or be selectively formed on any one thereof as needed.

In addition, since the transformer 100 according to the present embodiment has a reduced thickness as described above, the insulating rib 27 may not excessively protrude from the flange part 23. Therefore, the insulating rib 27 according to the present embodiment may protrude outwardly (that is, upwardly or downwardly) along an outer peripheral surface of the flange part 23 and at a thickness similar to that of the flange part 23.

Due to the shape of the insulating rib 27 as described above, the transformer 100 according to the present embodiment may secure the strength of the flange part 23 while significantly reducing a protruding distance of the insulating rib 27.

However, the present invention is not limited thereto but may be variously applied. For example, the protruding distance of the insulating rib 27 may be set corresponding to a creepage distance, similar to an insulating rib 37 of an outer bobbin 30 to be described below.

In addition, although the accompanying drawings show a case in which the inner bobbin 20 includes only a single insulating rib 27 formed along the outer peripheral edge of the flange part 23, an insulating rib 27 may be additionally formed in order to further secure the strength of the flange part 23 or secure the creepage distance. In this case, the additionally formed insulating rib 27 may have a ring shape and protrude from an inner portion of the flange part 23 according to a shape of the flange part 23, similar to in an insulating rib 37 of an outer bobbin 30 to be described below.

In addition, when the inner bobbin 20 is formed of a material having high strength and the flange part 23 thus maintains its shape without being bent even though the insulating rib 27 is not formed in the inner bobbin 20, the insulating rib 27 of the inner bobbin 20 may be omitted.

In addition, as shown in FIG. 4, the insulating rib 27 according to the present embodiment may be formed only at a portion at which the inner bobbin 20 does not face an inner surface of a core 40 to be described below. That is, the insulating rib 27 according to the present embodiment may be formed only on an outer peripheral surface of the flange part 23 exposed to the outside of the core 40 at the time of the coupling of the core 40 to the bobbin part 10. This is to increase adhesion between the bobbin part 10 and the core 40. However, the present invention is not limited thereto. For example, the insulating rib 27 may be formed over the flange part 23 as needed. In addition, various applications may be provided. For example, the insulating rib 27 may protrude more on the flange part 23 exposed to the outside of the core 40 or may protrude less on the flange part 23 facing the inner surface of the core 40.

The flange part 23 of the inner bobbin 20 according to the present embodiment may be coupled to an outer bobbin 30 to be described below. To this end, the flange part 23 may include at least one fitting protrusion 28 and a support jaw 29 formed on the outer peripheral edge thereof.

A pair of fitting protrusions 28 may protrude from the outer peripheral edge of the upper flange part 23*a* in opposing directions. The present embodiment describes a case in which the fitting protrusions 28 respectively protrude from both ends of the outer peripheral edges of the upper flange part 23*a* maximally spaced apart from each other in an outer diameter direction by way of example. However, the present invention is not limited thereto.

In addition, the fitting protrusions 28 according to the present embodiment are not limited to a configuration in which they are formed in a pair, but may be variously configured. For example, a plurality of fitting protrusions 28 may be disposed on the outer peripheral edges of the flange part 23 in several directions.

Further, the present embodiment describes a case in which the fitting protrusions 28 protrude from a side formed by the flange part 23 and the insulating rib 27 by way of example. However, the present invention is not limited thereto but may be variously applied. For example, the fitting protrusions 28 may protrude only from the side of the flange part 23 or only from the side of the insulating rib 27.

The support jaw 29 may be formed on the lower flange part 23*b* and may be formed at a position corresponding to the position at which the fitting protrusion 28 is formed on the other side of the lower flange part 23*b*, which is an opposing side to the terminal connection part 24. More specifically, the support jaw 29 may protrude from the insulating rib 27 formed on the lower flange part 23*b* in an outer diameter direction.

This support jaw 29 may support a lower surface of the outer bobbin 30 when the inner bobbin is coupled to the outer bobbin 30, similar to the support part 29*a* of the terminal connection part 24 described above.

As described above, the fitting protrusion 28 and the support jaw 29 may be formed on the upper flange part 23*a* and the lower flange part 23*b*, respectively, such that when the inner bobbin 20 is coupled to an outer bobbin 30 to be described below, it is not easily separated from the outer bobbin 30. A detailed description thereof will be provided in a description of an outer bobbin 30 below.

The outer bobbin 30 may have a similar shape to that of the inner bobbin 20 and have the approximately same thickness as that of the inner bobbin 20; however, it has a different size therefrom, as shown in FIGS. 3, 6, and 7A.

The outer bobbin 30 may include a body part 32 having a through-hole 31 formed at the center of an inner portion thereof, a flange part 33, a terminal connection part 34, and external connection terminals 36, similar to the inner bobbin 20. Therefore, a detailed description of configurations of the outer bobbin 30 the same as those of the inner bobbin 20 will be omitted and only a detailed description of configurations of the outer bobbin 30 different therefrom will be provided.

The through-hole 31 formed in the inner portion of the body part 32 may be used as a space into which the inner bobbin 20 is inserted. Therefore, the through-hole 31 formed in the outer bobbin 30 may have an inner peripheral edge having a shape corresponding to that of the outer peripheral edge of the flange part 23 of the inner bobbin 20.

In addition, a space formed between an outer peripheral surface of the body part 32 of the outer bobbin 30 and the flange part 33 may be used as an outer winding part 30*a* around which a coil 50 to be described below is wound.

Similarly to the inner bobbin 20, a lower flange part 33*b* of the outer bobbin 30 may include the terminal connection part 34 formed on one side thereof, wherein the terminal connection part 34 includes the external connection terminals 36 connected thereto.

The terminal connection part 34 may protrude from the lower flange part 33*b* in an outer diameter direction of the body part 32, and may include guide protrusions 34*a*, lead grooves 35, and a spacing block 34*b*.

A plurality of guide protrusions 34*a* protrude downwardly from a lower surface of the terminal connection part 34 in parallel with each other. The guide protrusion 34*a* is to guide a lead wire of the coil 50 wound around the outer winding part 30*a* so that the lead wire may be easily connected to the external connection terminal 36, as shown in FIG. 1B. Therefore, the guide protrusion 34*a* may protrude beyond a diameter of the lead wire of the coil 50 so as to firmly guide the coil 50.

The lead groove 35 may be formed in plural in spaces between the guide protrusions 34*a*, and may be used as a path through which the lead wire of the coil 50 wound around the outer winding part 30*a* moves to the lower surface of the terminal connection part 34.

Due to the configuration of the terminal connection part 34 as described above, the lead wire of the coil 50 wound around the outer winding part 30*a* may move to a lower portion of the outer bobbin 30 via the lead groove 35 and may be then electrically connected to the external connection terminals 36 through the spaces between the guide protrusions 34*a* disposed adjacent to each other, as shown in FIGS. 1A and 1B. Here, the lead wire of the coil 50 may be wound around the guide protrusion 34*a* one time or several times and then connected to the external connection terminal 36 so that it may be more firmly fixed thereto.

The spacing block 34*b* may be used to secure a creepage distance between the external connection terminal 36 and the inner bobbin 20. To this end, the spacing block 34*b* may protrude between the guide protrusion 34*a* and the inner bobbin 20, that is, the through-hole 31 in a direction perpendicular to a direction in which the guide protrusion 34*a* is disposed.

The external connection terminals 36 may be connected to the terminal connection part 34 so that they protrude from a distal end of the terminal connection part 34 in a downward direction or an outer diameter direction of the body part 32.

Further, the flange part 33 included in the outer bobbin 30 according to the present embodiment may have a maximally reduced thickness, similar to the case of the inner bobbin 20.

Therefore, at least one insulating rib 37 may be provided on the flange part 33 in order to prevent the flange part 33 from being bent and secure the strength of the flange part 33.

Here, the insulating rib 37 formed on the outer bobbin 30 may be formed in plural, similar to the case of the inner bobbin 20. In addition, the insulating rib 37 may protrude by a distance through which a creepage distance may be secured between the coil 50 wound around the outer bobbin 30 and the coil 50 wound around the inner bobbin 20 while the strength of the flange part 33 is maintained.

A detailed description thereof will be provided below.

As shown in FIG. 3, when the inner bobbin 20 and the outer bobbin 30 are coupled to each other, a creepage distance between a primary coil 50*a* wound around the inner bobbin 20 and a secondary coil 50*b* wound around the outer bobbin 30 may be mainly formed along an outer surface of the flange part 33 of the outer bobbin 30.

Therefore, in the transformer 100 according to the present embodiment, the insulating rib 37 may be used in order to secure a creepage distance while significantly reducing a size of the outer bobbin 30. That is, the number and the protruding distance of insulating ribs 37 may be controlled, thereby securing the creepage distance between the coil 50 wound around the inner bobbin 20 and the coil 50 wound around the outer bobbin 30.

Here, in the case in which the flange part 23 of the inner bobbin 20 is extended to be sufficiently long, an empty space S having a predetermined interval may be formed between an outer surface of the primary coil 50*a* wound around the inner winding part 20*a* and an inner peripheral surface of the outer bobbin 30. Therefore, in this case, a distance between the primary coil 50*a* and the secondary coil 50*b* may be further secured. As a result, even though only a single insulating rib 37 is provided, the creepage distance may be easily secured. This may be equally applied to a case in which the flange part 33 of the outer bobbin 30 is extended to be sufficiently long.

On the other hand, in the case in which the flange part 23 or 33 of the inner or outer bobbin 20 or 30 has a short length to thereby have a difficulty in securing the creepage distance only with a width of the flange part 23 or 33, the transformer 100 according to the present embodiment may include an insulating rib 37 additionally formed on the flange part 33 of the outer bobbin 30, whereby the creepage distance may be secured.

As a result, a plurality of insulating ribs 37 formed on the outer bobbin 30 may be configured to have different protrusion distances in order to secure the creepage distance.

Similar to the case of the inner bobbin 20, the insulating rib 37 formed on the outer bobbin 30 may be formed on both of outer surfaces of two flange parts 33*a* and 33*b* included in the outer bobbin 30 or be selectively formed on any one thereof as needed. In addition, the insulating rib 37 may be formed along an outer peripheral edge of the flange part 33 or be formed in a ring shape and protrude from an inner portion of the flange part 33.

Furthermore, the insulating rib 37 of the outer bobbin 30 may be formed only at a portion at which the outer bobbin 30 does not face the inner surface of the core 40, and may be omitted in the case in which the flange part 33 maintains its shape without being bent even though the insulating rib 37 is not formed, similar to the insulating rib 27 of the inner bobbin 20.

The outer bobbin 30 according to the present embodiment may include at least one coupling groove 38 formed in an inner peripheral surface of the body part 32 so that the inner bobbin 20 inserted into the through-hole 31 may be fixed thereto.

The coupling groove 38 may be formed to correspond to the number, the position, and the shape of the fitting protrusions 28 formed on the inner bobbin 20.

In the case of the present embodiment, a pair of fitting protrusions 28 may protrude from the outer peripheral edge of the upper flange part 23*a* of the inner bobbin 20 in opposing directions. Correspondingly, a pair of coupling grooves 38 may be formed at a position facing each other in an inner peripheral surface of the through-hole 31 of the outer bobbin 30.

The coupling groove 38 may be formed in a groove shape having a predetermined width in the inner peripheral surface of the body part 32 (that is, the through-hole) of the outer bobbin 30 and may include first and second coupling grooves 38*a* and 38*b*.

The first coupling groove 38*a* may include a fitting groove 39*a* and a guide groove 39*b*.

Referring to FIG. 7B, the fitting groove 39*a* may be formed at one end, that is, an upper end, of the body part 32 of the outer bobbin 30 as a groove having a shape corresponding to that of the fitting protrusion 28. The fitting groove 39*a* may be a groove into which the fitting protrusion 28 of the inner bobbin 20 is fitted. The fitting protrusions 28 may be fitted into the fitting grooves 39*a* of the first and second coupling grooves 38*a* and 38*b*, whereby the inner and outer bobbins 20 and 30 may be finally coupled to each other. Therefore, when the fitting protrusion 28 is inserted into the fitting groove 39*a*, the inner bobbin 20 is completely inserted into the through-hole 31 of the outer bobbin 30, such that the inner bobbin 20 and the outer bobbin 30 are formed integrally with each other.

The guide groove 39*b* may be formed in a groove shape traversing the inner peripheral surface of the body part 32 of the outer bobbin 30 from the fitting groove toward the other end, that is, a lower end, of the body part 32 of the outer bobbin 30 and has an inclined bottom surface. That is, the guide groove 39*b* has a deepest depth at the other end of the body part 32 and a shallow depth at a position adjacent to the fitting groove 39*a*. The guide groove 39*b* may be used as a path through which the fitting protrusion 28 moves when the inner bobbin 20 is coupled to the outer bobbin 30.

The second coupling groove 38*b* may be formed at a position facing the first coupling groove 38*a* and may include only a fitting groove 39*a*. A detailed description thereof will be provided in a process of coupling the fitting protrusion 28 and the coupling groove 38 to each other to be described below.

Hereinafter, a process of coupling the fitting protrusion 28 and the coupling groove 38 to each other, that is, a process of coupling the inner bobbin 20 and the outer bobbin 30 will be described.

In order to couple the inner bobbin 20 to the outer bobbin 30, a process of inserting the other side of the inner bobbin 20 having the support jaw 29 formed thereon into the through-hole 31 of the outer bobbin 30 may be first performed. Here, the other side of the inner bobbin 20 may be inserted from a lower portion of the outer bobbin 30 into the through-hole 31 thereof. In addition, the fitting protrusion 28 of the inner bobbin 20 may be coupled to the second coupling groove 38*b* of the outer bobbin 30 while being slightly inserted thereinto.

Then, a process of pushing one side of the inner bobbin 20 having the terminal connection part 24 formed thereon into the through-hole 31 of the outer bobbin 30 may be performed. In this process, the fitting protrusion 28 at the side having the terminal connection part 24 formed thereon enters the guide groove 39*b* formed in the first coupling groove 38*a* of the outer bobbin 30.

As described above, since the guide groove 39*b* has the deepest depth at a lower end surface of the body part 32, the fitting protrusion 28 may be easily inserted into the guide groove 39*b* of the first coupling groove 38*a*.

The inner bobbin 20 may be pushed into the through-hole 31 of the outer bobbin 30, whereby the fitting protrusion 28 inserted into the guide groove 39*b* moves upwardly of the body part 32 of the outer bobbin 30 along the guide groove 39*b* to be finally inserted into the fitting groove 39*a*. Here, the support part 29*a* formed in the terminal connection part 24 of the inner bobbin 20 and the support jaw 29 suppress the inner bobbin 20 from moving upwardly of the outer bobbin 30 while contacting the lower surface of the outer bobbin 30.

The fitting protrusion 28 may be inserted into the fitting groove 39*a* of the first coupling groove 38*a*, such that the fitting protrusion 28 is caught by a step dividing the guide groove 39*b* and the fitting groove 39*a*. Therefore, downward movement of the inner bobbin 20 may be suppressed. In addition, the support jaw 29 and the support part 29*a* of the terminal connection part 24 support the lower end surface of the outer bobbin 30, such that upward movement of the inner bobbin 20 is suppressed. Therefore, after the coupling of the inner and outer bobbins 20 and 30 is completed, the inner bobbin 20 may not be easily separated from the outer bobbin 30.

Meanwhile, in the transformer 100 according to the present embodiment, since the fitting protrusion 28 is directly inserted into the second coupling groove 38*b* of the outer bobbin 30, the second coupling groove 38*b* does not have to include a separate guide groove for guiding the fitting protrusion 28 to the fitting groove 39*a*. Therefore, the second coupling groove 38*b* according to the present embodiment may include only the fitting groove 39*a*.

Therefore, in the transformer 100 according to the present embodiment, the first and second coupling grooves 38*a* and 38*b* may have different shapes. However, the transformer 100 according to the present embodiment is not limited thereto but may be formed in various forms, as needed, as long as the fitting protrusion 28 may be easily fitted into the fitting groove 39*a*. For example, the second coupling groove 38*b* may be formed to have the same shape as that of the first coupling groove 38*a*.

Meanwhile, as shown in FIGS. 3, 7A and 7B, in the transformer 100 according to the present embodiment, the flange parts 23 and 33 of individual bobbins (the inner and outer bobbins 20 and 30) may have a width larger than a thickness of the body parts 22 and 32. Here, although FIGS. 7A and 7B show only a cross-section of the outer bobbin 30 for convenience of description, the above-mentioned feature may also be applied to the inner bobbin 20.

This shape may be derived from a feature in which the transformer 100 according to the present embodiment has a reduced thickness. That is, the transformer 100 according to the present embodiment may be a thin transformer 100 having a significantly reduced thickness. For example, the transformer 100 including the external connection terminals 26 and 36 may have the entire vertical thickness of about 12 nm or less.

In order to secure an output voltage in the transformer 100 having the reduced thickness as described above (in order to secure the turn number of the coil), the respective winding parts 20*a* and 30*a* having the coils 50 wound therearound needs to have a deeper depth in the individual bobbins 20 and 30 according to the present embodiment than in the bobbin according to the related art.

To this end, in the individual bobbins 20 and 30 according to the present embodiment, the flange parts 23 and 33 may have a width W (See FIG. 7B) larger than a thickness T (See FIG. 7B) of the body parts 22 and 32.

In addition, in the inner and outer bobbins 20 and 30 according to the present embodiment, the flange parts 23 and 33 may have inclined inner surfaces (that is, surfaces forming the inner winding part and the outer winding part). As a result, the flange parts 23 and 33 may have a thickness that becomes thinner toward an outer diameter direction.

Although FIG. 7B shows only a cross-section of the outer bobbin 30, the above-mentioned feature may also be applied to the inner bobbin 20, as described above. Referring to FIG. 7B, the flange parts 23 and 33 have a basic thickness of D1. However, a thickness of the flange parts 23 and 33 becomes thinner in the outer diameter direction, such that the flange parts 23 and 33 have a thickness of D2 at outer peripheral edges thereof. That is, the winding parts 20*a* and 30*a* may have a width that increases in the outer diameter direction.

These configurations may be derived from the thin transformer 100 according to the present embodiment thin. More specifically, in the transformer 100 according to the present embodiment, the flange parts 23 and 33 may have the width larger than the thickness of the body parts 22 and 32, such that the respective winding parts 20*a* and 30*a* of the individual bobbins 20 and 30 have a significantly deeper depth than that of the winding parts of the bobbins in the transformer according to the related art. Due to this specific structure, a mold inserted into the winding parts 20*a* and 30*a* during a process of manufacturing the individual bobbins 20 and 30 may not be easily separated from the individual bobbins 20 and 30.

However, in the transformer 100 according to the present embodiment, the winding parts 20*a* and 30*a* may have the width that increases in the outer diameter direction, whereby the mold may be easily separated from the individual bobbins 20 and 30.

Meanwhile, the flange parts 23 and 33 according to the present embodiment may have the thickness that decreases in the outer diameter direction, such that it may be easily bent. However, as described above, the flange parts 23 and 33 according to the present embodiment may include the insulating ribs 27 and 37 formed on the outer surfaces thereof. Therefore, even though the thickness of the flange parts becomes thin, the bending of the flange parts may be prevented.

In the bobbin part 10 according to the present embodiment configured as described above, the external connection terminals 26 included in the inner bobbin 20 and the external connection terminals 36 included in the outer bobbin 30 may be disposed to be maximally spaced apart from each other. Therefore, when the inner bobbin 20 is coupled to the outer bobbin 30, it may be coupled to the outer bobbin 30 so that a portion at which the terminal connection part 24 is formed is positioned in an opposing direction to a portion at which the terminal connection part 34 of the outer bobbin 30 is formed.

Therefore, the external connection terminals 36 of the outer bobbin 30 and the external connection terminals 26 of the inner bobbin 20 may be disposed to protrude in opposing directions. Therefore, in the transformer 100 according to the present embodiment, the external connection terminals 26 of the primary coil 50*a* may be sufficiently spaced apart from the external connection terminals 36 of the secondary coil 50*b*, whereby an insulation distance between the primary and secondary coils may be easily secured.

In addition, as shown in FIG. 3, in the transformer 100 according to the present embodiment, an insulation property between the primary coil 50*a* wound around the inner winding part 20*a* and the secondary coil 50*b* wound around the outer winding part 30*a* may be secured by the outer bobbin 30. Therefore, the primary and secondary coils 50*a* and 50*b* may be disposed to be maximally adjacent to each other.

However, in order to secure output characteristics of the transformer 100 or a creepage distance, an outer surface of the primary coil 50*a* may also be spaced apart from the inner peripheral surface of the through-hole 31 of the outer bobbin 30 by a predetermined interval. This may be easily applied by controlling the width of the flange part 23 of the inner bobbin 20 or the turn number of the primary coil 50*a* wound around the inner bobbin.

Further, in the bobbin part 10 according to the present embodiment, when the inner bobbin 20 and the outer bobbin 30 are coupled to each other, the flange part 23 of the inner bobbin 20 and the flange part 33 of the outer bobbin 30 may be positioned on the same plane. That is, the bobbin part 10 in which the inner bobbin 20 and the outer bobbin 30 are coupled to each other may include partially protruding parts only at the portions at which the insulating ribs 27 or 37 or the terminal connection parts 24 and 34 are formed and has an entirely flat thin shape. Therefore, even in the case that the bobbin part is mounted on a substrate, it may be mounted at a significantly low height, such that it may be easily used in a thin display device, or the like.

Further, although the present embodiment describes a case in which the bobbin part 10 is configured of a single outer bobbin 30 and a single inner bobbin 20 by way of example, the present invention is not limited thereto. A plurality of bobbins may be inserted into the single outer bobbin 30. For example, the bobbin part 10 may be configured so that a separate bobbin (hereinafter, referred to as an intermediate bobbin) having a similar shape to that of the outer bobbin 30 is inserted into the through-hole 31 of the outer bobbin 30 and the inner bobbin 20 is inserted into a through-hole of the intermediate bobbin, and the core 40 may be configured to be inserted into the through-hole 21 of the inner bobbin 20.

In this case, any one of the primary and secondary coils may be selectively wound around two of three individual bobbins.

The individual bobbins 20 and 30 of the bobbin part 10 according to the present embodiment configured as described above may be easily manufactured by an injection molding method. However, the present invention is not limited thereto. The individual bobbins 20 and 30 may be manufactured by various methods such as a press processing method, or the like. In addition, the individual bobbins 20 and 30 of the bobbin part 10 according to the present embodiment may be formed of an insulating resin material and a material having high heat resistance and high voltage resistance. As a material of the individual bobbins 20 and 30, polyphenylenesulfide (PPS), liquid crystal polyester (LCP), polybutyleneterephthalate (PBT), polyethyleneterephthalate (PET), phenolic resin, and the like, may be used.

The coil 50 may include the primary coil 50*a* and the secondary coil 50*b*.

The primary coil 50*a* may be wound around the inner winding part 20*a* formed in the inner bobbin 20.

Further, the primary coil 50*a* according to the present embodiment may include a plurality of coils electrically insulated from each other and wound around a single inner winding part 20*a*. That is, in the transformer 100 according to the present embodiment, the primary coils 50 may be configured of the plurality of coils, such that a voltage may be selectively applied to each of the coils and various voltages may be drawn through the secondary coil 50*b* correspondingly.

To this end, as the plurality of coils configuring the primary coil 50*a*, coils having different diameters and turns may be used. In addition, a single wire or a twisted pair wire formed by twisting several strands may be used.

The lead wire of the primary coil 50*a* may be connected to the external connection terminal 26 included in the inner bobbin 20.

The secondary coil 50*b* may be wound around the outer winding part 30*a* formed in the outer bobbin 30.

Similar to the above-mentioned primary coil 50*a*, the secondary coil 50*b* may also include a plurality of coils electrically insulated from each other. An example thereof is shown in FIG. 3. The lead wire of the secondary coil 50*b* may be connected to the external connection terminal 36 included in the outer bobbin 30.

Meanwhile, the present embodiment describes a case in which the primary coil 50*a* is wound around the inner winding part 20*a* and the secondary coil 50*b* is wound around the outer winding part 30*a* by way of example. However, the present invention is not limited thereto but may be variously applied as long as a voltage desired by a user may be drawn. For example, the primary coil 50*a* may be wound around the outer winding part 30*a* and the secondary coil 50*b* may be wound around the inner winding part 20*a*.

The core 40 may be inserted into the through-hole 21 formed in the inner portion of the inner bobbin 20 and may be electromagnetically coupled to the coil 50 to thereby form a magnetic path.

The core 40 according to the present embodiment may be configured in a pair. The pair of cores 40 may be each inserted into the through-hole 21 of the inner bobbin 20 to thereby be connected to each other while facing each other. As the core 40, an 'EE' core, an 'EI' core, or the like, may be used.

The core 40 may be formed of Mn—Zn based ferrite having higher permeability, lower loss, higher magnetic flux saturation density, higher stability, and lower production costs, as compared to other materials. However, in an embodiment of the present invention, the shape or the material of the core 40 is not limited.

Meanwhile, although not shown, the bobbin part 10 and the core 40 according to the present embodiment may include an insulating tape interposed therebetween. The insulating tape may be provided in order to secure an insulation property between the coil 50 wound around the bobbin part 10 and the core 40.

The insulating tape may be interposed between the bobbin part 10 and the core 40 corresponding to the entire inner peripheral surface of the core 40 facing the bobbin part 10 or be partially interposed therebetween only at a portion at which the coil 50 and the core 40 face each other.

Figure 8:
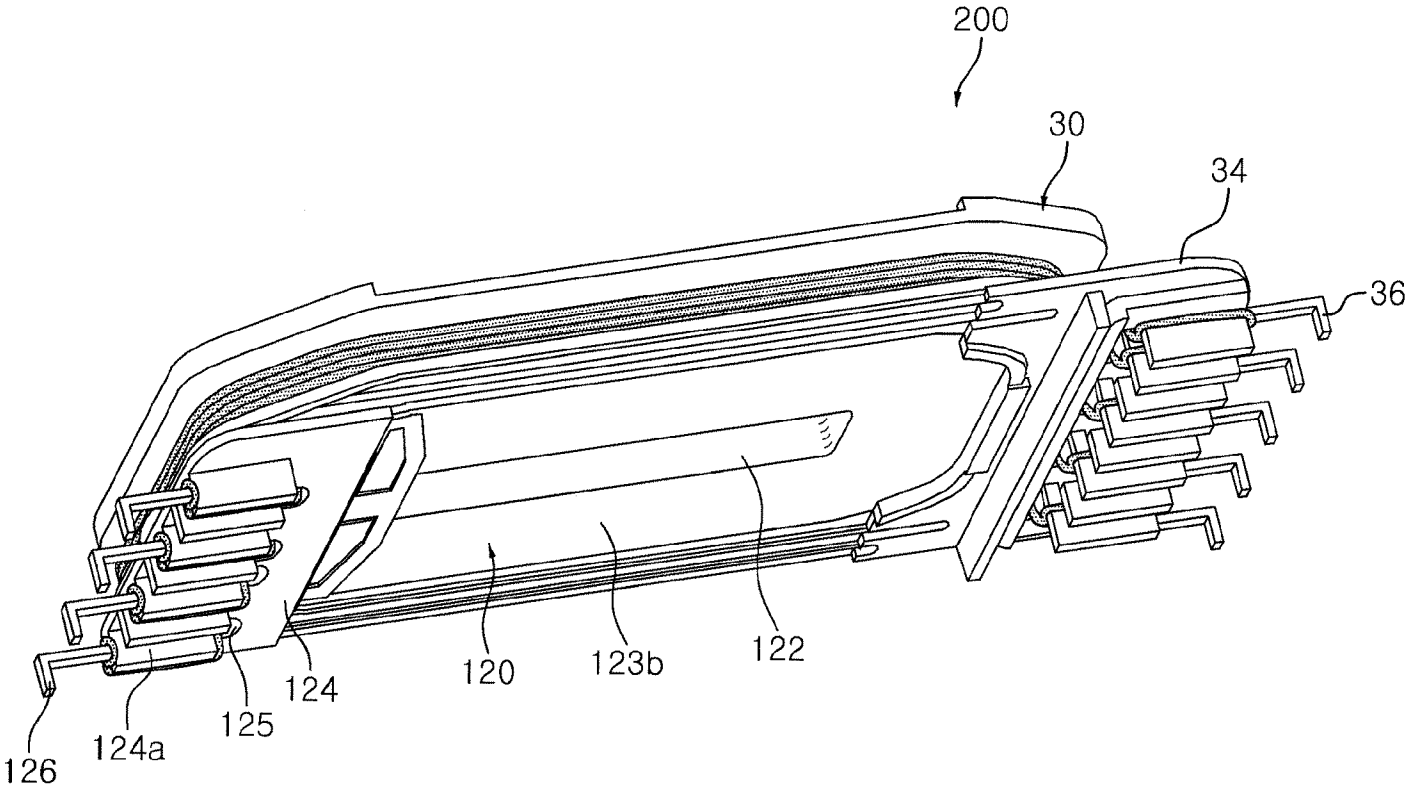
FIG. 8 is a perspective view schematically showing a transformer according to another embodiment of the present invention.

FIG. 8 is a perspective view schematically showing a transformer according to another embodiment of the present invention. A transformer 200 according to the present embodiment may have a similar configuration to that of the transformer 100 (See FIG. 1) according to the above-mentioned embodiment and may be different therefrom only in a configuration of a terminal connection part 124 of an inner bobbin 120. Therefore, a detailed description of components configured identically to those of the above-mentioned embodiment will be omitted, and a configuration of the terminal connection part 124 of the inner bobbin 120 will be mainly described.

Referring to FIG. 8, the terminal connection part 124 of the inner bobbin 120 according to the present embodiment may protrude from a lower surface of a lower flange part 123*b* in an outer diameter direction of a body part 122. Here, the terminal connection part 124 may protrude by an amount corresponding to an outer peripheral surface of the lower flange part 33*b* of the outer bobbin 30 and has a flat upper surface.

In addition, the outer bobbin 30 according to the present embodiment may be formed to be flat without forming an insulating rib on an outer surface of the lower flange part 33*b* facing the upper surface of the terminal connection part 124. Therefore, the inner bobbin 120 may be coupled to the outer bobbin 30 while the upper surface of the terminal connection part 124 surface-contacts the lower surface of the lower flange part 33*b* of the outer bobbin 30.

The terminal connection part 124 may include guide protrusions 124*a* and lead grooves 125, similar to the terminal connection part 34 of the outer bobbin 30.

A plurality of guide protrusions 124*a* may protrude from a lower surface of the terminal connection part 124 in a downward direction of the body part 122 in parallel with each other. The guide protrusion 124*a* is to guide a lead wire of the coil 50 wound around the outer winding part so that the lead wire may be easily connected to an external connection terminal 126. Therefore, the guide protrusion 124*a* may protrude beyond a diameter of the lead wire of the coil 50 so as to firmly guide the coil 50.

The lead grooves 125 may be formed in spaces between the guide protrusions 124*a*, respectively, and may be used as a path through which the lead wire of the coil 50 wound around the inner winding part moves to the lower surface of the terminal connection part 124.

Due to the configuration of the terminal connection part 124 as described above, the lead wire of the coil 50 wound around the inner winding part may move to a lower portion of the inner bobbin 120 via the lead groove 125 and may be then electrically connected to the external connection terminals 126 through the spaces between the guide protrusions 124*a*.

The external connection terminals 126 may be connected to the terminal connection part 124 so that they protrude from the terminal connection part 124 in the downward direction or the outer diameter direction of the body part 122. Particularly, the external connection terminal 126 according to the present embodiment may be connected to the terminal connection part 124 in a form corresponding to the outer peripheral edge of the lower flange part 33*b* of the outer bobbin 30.

Meanwhile, the present invention is not limited to the above-mentioned configuration but may be variously applied. For example, the terminal connection part 124 may protrude outwardly of the outer peripheral edge of the lower flange part 33*b* of the outer bobbin 30 in order to secure an insulation property between the outer connection terminal 126 of the inner bobbin 120 and the coil 50 wound around the outer bobbin 30.

As described above, in the transformer 200 according to the present embodiment, the outer connection terminal 126 of the inner bobbin 120 may protrude beyond the outer bobbin 30, whereby an insulation property between the outer connection terminal of the inner bobbin 120 and the external connection terminal 36 of the outer bobbin 30 may be further secured. In addition, when the transformer 200 is mounted on a substrate (not shown), all of the external connection terminals 36 and 126 may be mounted thereon while being easily seen with the naked eyes, whereby the transformer may be more easily mounted.

Figure 9A:
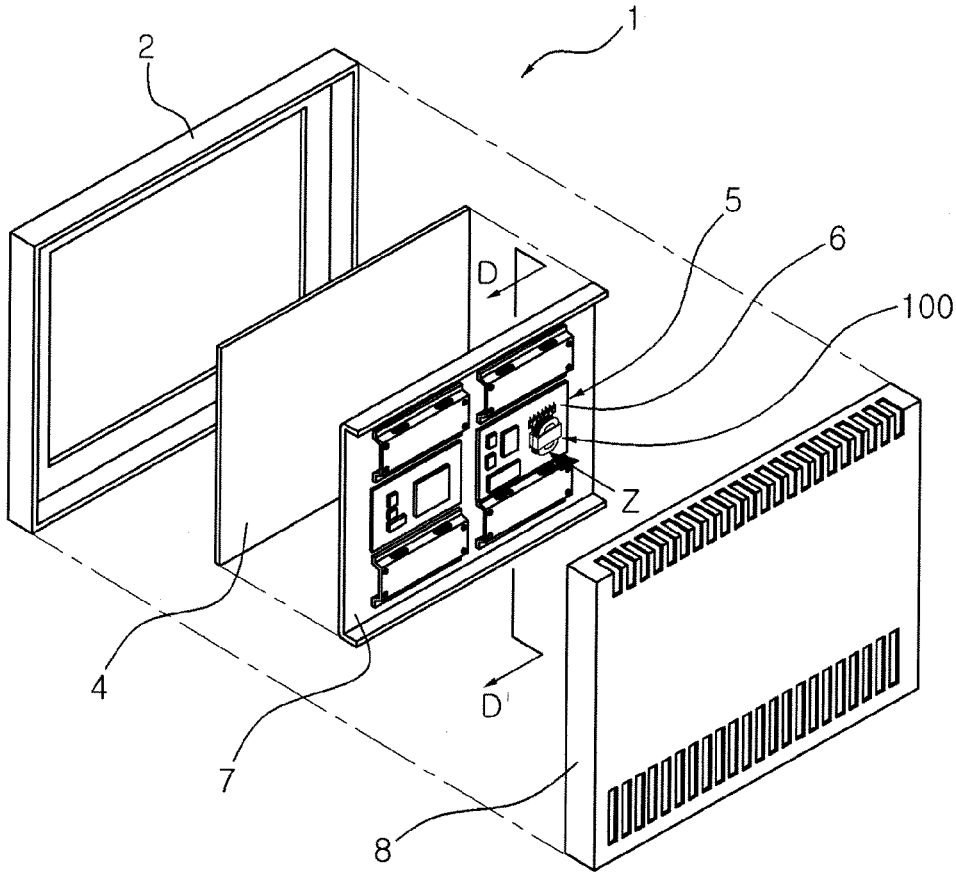
FIG. 9A is an exploded perspective view schematically showing a flat panel display device according to an embodiment of the present invention.
Figure 9B:
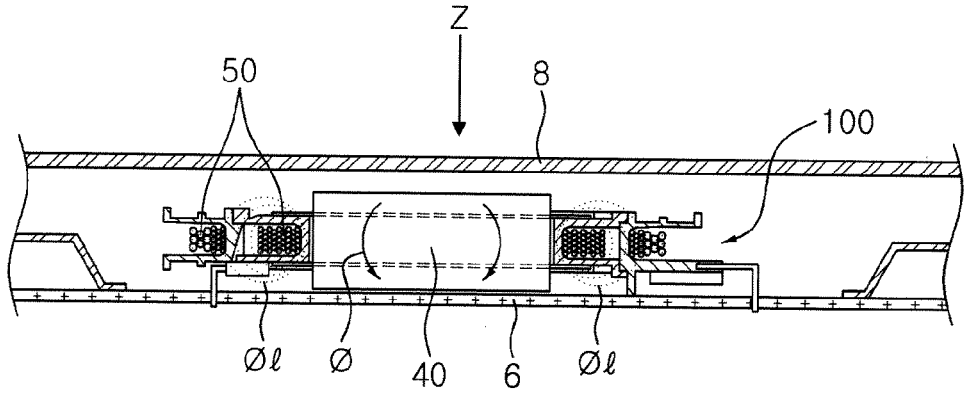
FIG. 9B is a partial cross-sectional view taken along line D-D' of FIG. 9A.

FIG. 9A is an exploded perspective view schematically showing a flat panel display device according to an embodiment of the present invention; and FIG. 9B is a partial cross-sectional view taken along line D-D' of FIG. 9A.

First referring to FIG. 9A, a flat panel display device 1 according to an embodiment of the present invention may include a display panel 4, a switching mode power supply (SMPS) 5 having the transformer 100 mounted therein, and covers 2 and 8.

The covers 2 and 8 may include a front cover 2 and a back cover 8 and may be coupled to each other to thereby form a space therebetween.

The display panel 4 may be disposed in an internal space formed by the covers 2 and 8. As the display panel, various flat panel display panels such as a liquid crystal display (LCD), a plasma display panel (PDP), an organic light emitting diode (OLED), and the like, may be used.

An SMPS 5 provides power to the display panel 4. The SMPS 5 may be formed by mounting a plurality of electronic components on a printed circuit board 6 thereof and particularly, may include at least one of the transformers 100 and 200 according to the above-mentioned embodiments mounted therein. The present embodiment describes a case in which the SMPS includes the transformer 100 of FIG. 1 by way of example.

The SMPS 5 may be fixed to a chassis 7, and be disposed and fixed in the internal space formed by the covers 2 and 8 together with the display panel 4.

As shown in FIG. 9B, in the transformer 100 mounted in the SMPS 5, the coil 50 may be wound in a direction that is in parallel with the printed circuit board 6. In addition, when viewed from a plane of the printed circuit board 6 (a Z direction), the coil 50 may be wound clockwise or counterclockwise. Further, a portion (an upper surface) of the core 40 forms a magnetic path while being in parallel with the back cover 8.

Therefore, in the transformer 100 according to the present embodiment, as shown in FIG. 9B, a magnetic path of most of magnetic flux $\phi$ formed between the back cover 8 and the transformer 100 among a magnetic field generated by the coil 50 may be formed in the core 40, whereby the formation of leakage magnetic flux $\phi_1$ between the back cover and the transformer 100 may be significantly reduced.

That is, the transformer 100 according to the present embodiment may be configured so that the coil 50 is wound in a direction that is in parallel with the printed circuit board 6, whereby a magnetic path of leakage magnetic flux $\phi_1$ is partially formed to be small without being formed over a space between the transformer 100 and the back cover 8.

Therefore, even though the transformer 100 according to the present embodiment does not include a separate shielding device (for example, a shielding shield, or the like) on an outer portion thereof, it may significantly reduce the generation of interference between the leakage flux $\phi_1$ and the back cover 8 formed of a metal material.

Therefore, even though the transformer 100 is mounted in a thin electronic device such as the flat panel display device 1 to allow the back cover 8 and the transformer 100 to have a significantly narrow space therebetween, the generation of noise due to vibrations of the back cover 8 may be prevented.

The transformer disclosed in the present embodiments described above may be configured to be appropriate for an automated manufacturing method.

That is, the transformer according to the present embodiment may be completed by individually winding the coils around the inner and outer bobbins, respectively, coupling the inner and outer bobbins to each other, and then coupling the core thereto.

As described above, the transformer according to an embodiment of the present invention may be configured so that each of the coils may be wound in a state in which the inner and outer bobbin are separated from each other, in order to automatically wind the primary coil and the secondary coil. Here, the coils may be wound by a separate automatic winding device.

In addition, in the inner and outer bobbins according to an embodiment of the present invention, the lead wires of the automatically wound primary and secondary coils may be primarily fixed by the lead grooves, the guide protrusions, and the like, formed in the terminal connection part and be then connected to the external connection terminals. Therefore, when the lead wires of the coils are connected to the external connection terminals during a process of automatically winding the coils, a phenomenon that they are easily released may be prevented.

In addition, after the winding of the coils is completed, the inner and outer bobbins may be easily coupled to each other through the fitting protrusion and the coupling groove. This process may be automatically performed through a separate device.

As described above, most of a process of manufacturing the transformer according to an embodiment of the present invention may be automated. Therefore, a cost and a time required for manufacturing the transformer may be significantly reduced.

In addition, the transformer according to the present invention has a significantly reduced thickness. Therefore, it may be easily used in various thin devices.

Meanwhile, the transformer and the flat panel display device including the same according to the embodiment of the present invention described above are not limited to the aforementioned embodiments but may be variously applied. For example, the coupling between the inner and outer bobbins according to the embodiment is not limited to the coupling using the fitting protrusion and the coupling groove.

That is, various configurations may be applied as long as adhesion between the inner and outer bobbins may be secured. For example, at least one of an outer peripheral edge of the flange part of the inner bobbin and an inner peripheral surface of the through-hole of the outer bobbin may include at least one fitting protrusion protruding therefrom and the other thereof may include a coupling groove formed to correspond to the fitting protrusion and having the fitting protrusion coupled thereto.

In addition, the above-mentioned embodiments describe a case in which the individual bobbins have an approximately rectangular parallelepiped shape. However, the present invention is not limited thereto. The individual bobbins may have various shapes such as a cylindrical shape, or the like, as long as a desired voltage may be drawn.

In addition, although the present embodiment describes the transformer used in the display device by way of example, the present invention is not limited thereto but may be widely applied to a thin electronic device including the transformer.

As set forth above, the transformer according to the embodiment of the present invention may have a structure in which it includes a plurality of individually divided bobbins (for example, the inner and outer bobbins) and these bobbins are coupled to each other. Therefore, the transformer may be completed by winding the coils around the individual bobbins, respectively, and then coupling the individual bobbins to each other. Therefore, a production process may be automated, whereby costs and a time required for manufacturing the transformer may be significantly reduced.

Further, in the transformer according to the embodiment of the present invention, the inner and outer bobbins include the flange part having the width larger than the thickness of the body part. Therefore, the transformer has an entirely flat thin shape, whereby it may be easily used in a thin display device, or the like.

Furthermore, in the transformer according to the embodiment of the present invention, the inner and outer bobbins may be coupled to each other through the fitting protrusion and the fitting groove. Therefore, the inner bobbin may be easily coupled to the outer bobbin, and the inner bobbin may not be easily separated or does not easily protrude from the outer bobbin after the coupling therebetween is completed.

In addition, when the transformer according to the embodiment of the present invention is mounted on the substrate, the coil of the transformer may be maintained in a state in which it is wound in parallel with the substrate. When the coil is wound in parallel with the substrate as described above, interference between the leakage magnetic flux generated from the transformer and the outside (for example, the back cover) may be significantly reduced.

Therefore, even in the case that the transformer is mounted in the thin display device, the generation of the interference between the leakage magnetic flux generated from the transformer and the back cover of the display device may be significantly reduced. Therefore, a phenomenon in which noise is generated in the display device by the transformer may be prevented. Therefore, the transformer may be easily used in thin devices.

While the present invention has been shown and described in connection with the embodiments, it will be apparent to those skilled in the art that modifications and variations can be made without departing from the spirit and scope of the invention as defined by the appended claims.

What is claimed is:

1. A transformer comprising:

a bobbin part including inner and outer bobbins each including a pipe shaped body part having a though-hole formed in an inner portion thereof and a flange part protruding outwardly from both ends of the body part;

coils respectively wound around the inner and outer bobbins; and a core electromagnetically coupled to the coils to thereby form a magnetic path, the inner bobbin being inserted into the through-hole of the outer bobbin to thereby be coupled to the outer bobbin and at least one of the inner and outer bobbins including the flange part having a width larger than a thickness of the body part, wherein the inner bobbin includes at least one fitting protrusion protruding from an outer peripheral edge of an upper flange part formed at an upper end of the body part in an outer diameter direction thereof, wherein an inner peripheral surface of the through-hole of the outer bobbin includes at least one coupling groove formed in a position in which the at least one coupling groove has the at least one fitting protrusion of the inner bobbin inserted thereinto, wherein the inner bobbin includes a support jaw protruding from a position corresponding to the fitting protrusion in an outer peripheral edge of the lower flange part formed at the lower end of the body part in the outer diameter direction, and supporting a lower surface of the lower flange part of the outer bobbin.

2. The transformer of claim 1, wherein the inner bobbin is inserted into the through-hole of the outer bobbin so that the flange part of the inner bobbin and the flange part of the outer bobbin are disposed on the same plane.

3. The transformer of claim 1, wherein each of the inner and outer bobbins includes a terminal connection part protruding outwardly from one side of a lower flange part formed at a lower end of the body part and having a plurality of external connection terminals connected thereto.

4. The transformer of claim 3, wherein the terminal connection part respectively included in the inner and outer bobbins includes lead grooves formed in spaces between the external connection terminals, and the coil leads to a lower portion of the bobbin part via the lead groove.

5. The transformer of claim 1, wherein in the fitting protrusion, a pair of fitting protrusions protrude from the outer peripheral edge of the upper flange part of the inner bobbin in opposing directions.

6. The transformer of claim 1, wherein the coupling grooves are formed in a groove shape in an upper end of an inner peripheral surface of the body part of the outer bobbin and include fitting grooves having the fitting protrusions inserted thereinto.

7. The transformer of claim 6, wherein at least one of the pair of coupling grooves includes a guide groove formed in a groove shape traversing the inner peripheral surface of the body part of the outer bobbin from the fitting groove toward the lower end of the body part of the outer bobbin to thereby guide the fitting protrusion to the fitting groove.

8. The transformer of claim 7, wherein the guide groove has an inclined bottom surface, and the bottom surface has a depth that becomes shallower toward the fitting groove.

9. The transformer of claim 6, wherein the inner and outer bobbins are fixedly coupled to each other by fitting the fitting protrusion into the fitting groove and supporting a lower surface of the lower flange part of the outer bobbin by the terminal connection part and the support jaw of the inner bobbin.

10. The transformer of claim 1, wherein the coil includes a primary coil wound around the inner bobbin and a secondary coil wound around the outer bobbin, and at least one of the primary and secondary coils includes a plurality of coils electrically insulated from each other.

11. The transformer of claim 1, wherein the bobbin part further includes at least one intermediate bobbin interposed between the outer bobbin and the inner bobbin.

12. The transformer of claim 3, wherein the terminal connection part of the inner bobbin and the terminal connection part of the outer bobbin are disposed in opposing directions.

13. The transformer of claim 3, wherein an outer peripheral edge disposed on an upper part of the terminal connection part of the inner bobbin in an outer peripheral edge of the flange part formed at the upper end of the body part of the inner bobbin is bent corresponding to connection positions of the external connection terminals of the inner bobbin.

* * * * *